United States Patent [19]

Heinzel et al.

[11] Patent Number: 5,027,986

[45] Date of Patent: Jul. 2, 1991

[54] ACTUATING VALVE FOR AEROSOL FOAM PRODUCT

[76] Inventors: Irving C. Heinzel, 45 Brookdale La., Palatine, Ill. 60067; William R. Brooks, 7860 N. Tuscany Dr., Tucson, Ariz. 85741

[21] Appl. No.: 364,784

[22] Filed: Jun. 9, 1989

[51] Int. Cl.[5] ..... B65D 83/14

[52] U.S. Cl. ..... 222/402.24; 222/402.1; 222/520; 222/542

[58] Field of Search ..... 222/394, 402.1, 402.11, 222/402.14, 402.15, 402.17, 402.24, 509, 505, 519, 520, 542, 515–518

[56] References Cited

U.S. PATENT DOCUMENTS

| | | | |
|---|---|---|---|
| 2,757,964 | 8/1956 | Both et al. | 222/402.14 X |
| 2,941,700 | 6/1960 | Gable | 222/402.15 |
| 3,189,232 | 6/1965 | Joffe | 222/402.15 X |
| 3,534,890 | 10/1970 | Iannacone | 222/402.14 |
| 3,729,120 | 4/1973 | Sette et al. | 222/402.11 X |
| 3,756,472 | 9/1973 | Vos | 222/402.14 X |
| 3,844,448 | 10/1974 | Sette | 222/402.11 X |
| 3,967,763 | 7/1976 | Focht | 222/402.15 |
| 3,977,576 | 8/1976 | Amabili | 222/402.1 |
| 4,078,705 | 3/1978 | Butcher | 222/402.24 |
| 4,331,134 | 5/1982 | Brooks et al. | 128/90 |

FOREIGN PATENT DOCUMENTS

| | | | |
|---|---|---|---|
| 598068 | 5/1934 | Fed. Rep. of Germany | 222/402.11 |
| 2275184 | 11/1987 | Japan | 222/402.1 |

*Primary Examiner*—Kevin P. Shaver

*Attorney, Agent, or Firm*—Trexler, Bushnell, Giangiorgi & Blackstone, Ltd.

[57] ABSTRACT

A valve assembly for use with an aerosol container for controllably dispensing a substance disposed within the container under pressure of a propellant also contained therein. The valve assembly provides a high degree of precision control in the dispensing of the substance using a rotary actuator cooperatively engaged with a camming arrangement which transfers large rotary motion into small valve displacing linear motion. The valve is sealed by a resilient gasket which is protected from the deteriorating effects of chemicals in the substance and/or propellant by a flexibly deformable Teflon liner.

15 Claims, 2 Drawing Sheets

ACTUATING VALVE FOR AEROSOL FOAM PRODUCT

BACKGROUND OF THE INVENTION

This invention relates generally to the valve art and more particularly to a valve for use with an aerosol container. Still more particularly, the invention relates to a novel valve assembly for use with an aerosol container for attaining a high degree of control in the dispensing of a substance disposed within the container under pressure.

Currently, many products are available in an aerosol dispensing package for consumer convenience. Such products permit dispensing from the container in which the product is stored and provides the additional advantage of convenient use or application of the product. For example, many paints are sold in an aerosol sprayable paint form which permits the user to apply the paint without the complication or mess of using a brush or other application device and the product is stored in the container from which it is dispensed.

The dispensing mechanism used with an aerosol product container is very important since this is an interface element of the product which helps determine whether or not the consumer will continue to use the product. If a dispensing mechanism is difficult to control or operate, or messy to operate, a consumer may discontinue use of such a product. Therefore, it is very important to provide a well engineered dispensing mechanism considering the human factors required to operate the mechanism. An additional factor to consider is how the dispensing mechanism operates in the controlled dispensing for an appropriate amount of product.

While many aerosol products merely require an on/-off type valve, such that ether the valve is on and a continuous emission of product is released or the valve is off and no product is released, certain products, including aerosol foam require a high degree of precision or control in dispensing the product. For example, polyurethane foam sealants or other foam products are the type or products which require more precision in their application than merely an on/off type valve. Typically, these foam products are dispensed through the use of a tilt valve, however, the degree of control provided by the tilt valve is generally insufficient wherein precision control is necessary, unless the operator is highly skilled. The tilt valve does not provide sufficient magnification of the valve displacement to dispensing ratio and therefore provides a dispensing rate of product that is difficult to control. Nevertheless, the tilt valve has found use in the dispensing of aerosol foam products since more efficient alternatives have not been available, or were not economically feasible.

Further, polyurethane foam products swell substantially upon discharge from the container and therefore it is very important to provide precision control of the product to avoid waste, mess and damage resulting from too much product being dispensed and swelling within a confined area. The polyurethane foam product is a sticky material once dispensed which is capable of adhering to almost any surface and can be very difficult to remove especially since water actually accelerates the curing time of the product. Also, the muscle group used to control a tilt valve, either an index finger not in opposition with the thumb or a thumb not in opposition with an index finger, is not conducive of high precision control.

Generally, tilt valves and other aerosol valves are configured with a resilient gasket positioned between the valve and a top portion of the container to operatively seal the container yet permit unseating a portion of the valve when dispensing a product from the container. The ingredients in the liquid form of the polyurethane foam used in this application as well as the compatible propellants used with this product, in combination or alone, tend to have a deteriorating effect on the resilient gasket material. Deterioration of the gasket is manifested in hardening of the gasket which substantially reduces the shelf life of the product because once the gasket hardens (one to two months), the valve is no longer functional and the container may leak the polyurethane substance, propellant or both. While rigid materials have been found which are inert to commonly used propellants, resilient gasket material generally are not inert to such propellants, resilient materials which are inert to the propellants are deteriorated by the chemicals in the polyurethane substance.

Prior art valves have not provided solutions to the above-noted problems for the application of aerosol products in general and more specifically for the application of polyurethane foam products. Further, it was thought that the shelf life of polyurethane foam products could not be extended since many types and combinations of gasket materials have been tried in an attempt to overcome the deterioration problem caused by the chemicals in the liquid polyurethane material and the compatible propellant. However, the present invention has now solved the problems noted above in the dispensing of aerosol products.

The present invention, as will be detailed more fully hereinafter, overcomes the above-described problems. More specifically, the present invention provides a novel valve for use with an aerosol container for controllably dispensing a substance disposed within the container which is under pressure of a propellant also disposed within the container.

OBJECTS AND SUMMARY OF THE INVENTION

A general object of the present invention is to provide a valve assembly for use with an aerosol container which prevents chemicals in the substance and propellant disposed within the container from deteriorating a resilient gasket used to seal the valve assembly and container thereby extending the shelf life of the product.

Another object of the present invention is to provide a valve assembly for use with an aerosol container which permits a high degree of precision control in the dispensing of the substance disposed within the container.

A more specific object of the present invention is to provide sealing means including a resilient gasket and a protective liner such that the protective liner, when mounted in the structure of the valve, protects the resilient gasket from deterioration caused by chemicals in the substance and propellant disposed within the container.

A further object of the present invention is to provide a valve assembly for use with an aerosol container which precisely controllably actuates a valve stem to axially unseat a valve body from the sealing means to permit the substance disposed within the container to flow through the valve body without contacting the resilient gasket.

In accordance with the foregoing, the present invention comprises a novel valve assembly for use with an aerosol container which controllably dispenses a substance disposed within the container under pressure of a propellant also disposed within the container. The valve assembly is constructed to provide a sufficient seal between a displacably biased valve body and a top portion of the container, between which is positioned sealing means comprising a resilient gasket and a protective liner.

BRIEF DESCRIPTION OF THE DRAWINGS

The features of the present invention which are believed to be novel are set forth with particularity in the appended claims. The organization and manner of the invention, together with the further objects and advantages thereof, may best be understood by reference to the following description taken in connection with the accompanying drawings in which like reference numerals identify like elements, and in which:

Figure 1:
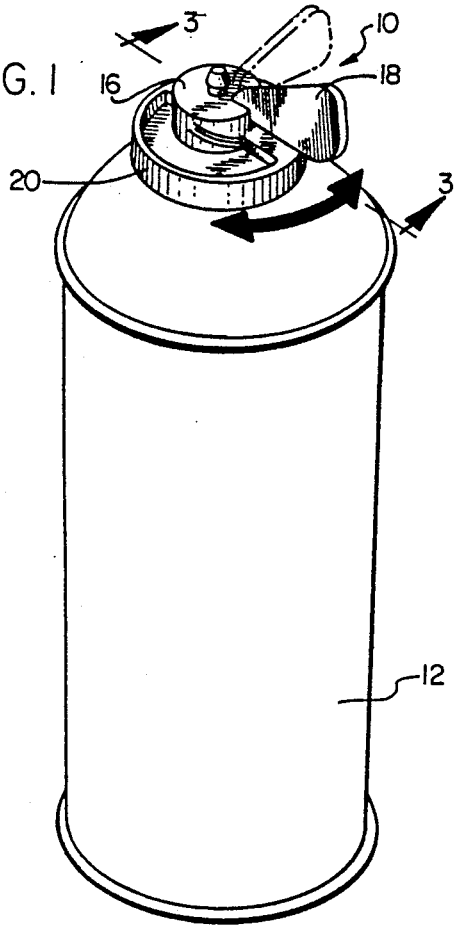
FIG. 1 is a perspective view of the valve assembly of the present invention mounted to an aerosol container.

It should be noted that the dimensional relationships between members of the illustrated embodiment may vary in practice and may have been varied in the illustrations to emphasize certain features of the invention.

DETAILED DESCRIPTION OF THE ILLUSTRATED EMBODIMENT

While this invention is susceptible to embodiment in many different forms, there is shown in the drawings, and will be herein described in detail one specific embodiment with the understanding that the present disclosure is to be considered an exemplification of the principles of the invention, and is not intended to limit the invention to the embodiment illustrated.

FIG. 1 provides a perspective view of the valve assembly 10 of the present invention mounted to an aerosol container 12. As indicated by the arrow 14, an actuator means 16 having a lever portion 18 attached thereto rotatably moves within a retention means or collar 20. The valve assembly 10 mounted to the top portion of the aerosol container 12 permits controlled dispensing of a substance disposed therein, as will become apparent from the discussion to follow.

Figure 2:
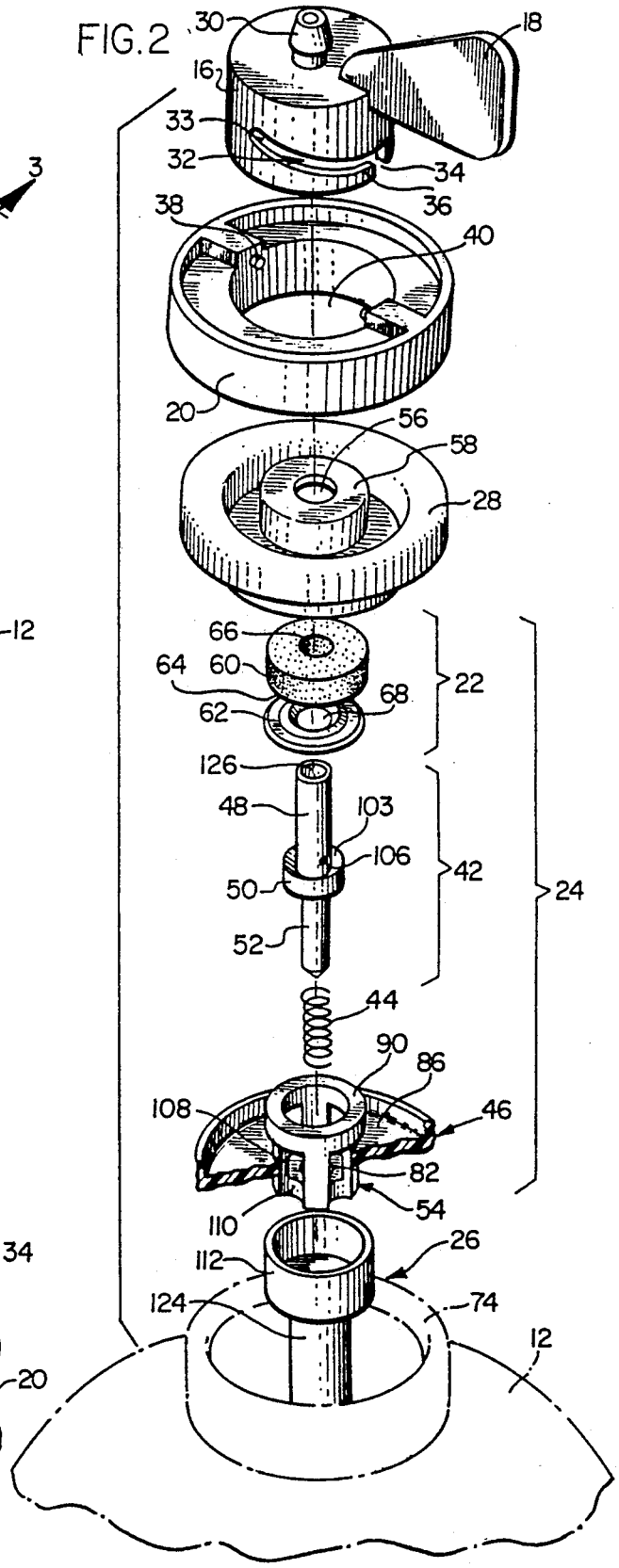
FIG. 2 is an enlarged exploded perspective view of the valve assembly.

An enlarged exploded perspective view of the valve assembly of the present invention is illustrated in FIG. 2. The valve assembly 10 comprises a number of components, of which the actuator means 16 and the collar 20 are mounted on the outside of the container 12 while the sealing means 22 and the valve means 24 are mounted on the inside of the container 12. Additionally, a dip tube 26 can be attached to the valve means 24, as will be described in further detail hereinbelow, for dispensing a substance while the container is in an upright position. It should be obvious to one skilled in the art that the dip tube 26 can be eliminated from the valve assembly 10 without departing from the scope of the invention. The container is sealed by the valve assembly 10 in conjunction with a container cap portion 28 to which components of the valve assembly 10 are attached.

The actuator means 16 has a generally cylindrical body shape with a generally hollow inner portion. An actuator nozzle 30 is positioned generally in the center of the top of the actuator means 16 to permit dispensing of the substance retained in the container 12 once the valve means 24 is actuated. A camming groove or cam groove 32 is formed in the outside surface of the body of the actuator means 16 having a generally spiral portion 33, an assembly notch 34 and a dwell portion 36. The cam groove 32 is generally dimensioned and formed to interconnect with camming pins or cam pins 38 formed on the retention means 20. The spiral portion 33 of the cam groove 32 is formed at an angle of approximately 27°. While other angles can be used for the spiral portion 33, an angle of 27° is preferred to achieve a desired camming action, which results in linear displacement of the valve means. The cam pins 38 are formed on an inside surface of an actuator means receiving bore or actuator bore 40 formed through the center of the retention means 20. It should be obvious to one skilled in the art that the cam pins 38 and cam groove 32 can be formed on either the actuator 16 or the retention means 20 as long as they are positioned to permit cooperative operation. The actuator bore 40 has an inside diameter generally slightly larger than the outside diameter of the body of the actuator means 16 providing a degree of support and reinforcement as well as ease of operation when rotating the actuator means 16 within the retention means 20.

Assembly of the actuator means 16 to the collar 20 is accomplished by positioning the actuator 16 in the actuator bore 40 to align the cam pins 38 in the corresponding assembly notch 34 and pressing the actuator means 16 downwardly on the cam pins 38. Positioned as such, the actuator means 16 can be rotated towards the spiral portion 33 of the cam groove 32. Thus assembled, the retention means and actuator means can be mounted to the container cap portion 28 for cooperative engagement with the valve means 24.

Valve means 24 comprises a valve body 42 cooperatively engaged with biasing means 44 and a valve base 46. The valve body 42 is a generally elongated cylindrical structure comprised of a dispensing passageway 48, a seating portion 50 and a stem portion 52. Biasing means 44 is preferably, although not necessarily, a coil spring through which the stem 52 projects. With the spring 44 positioned over the stem 52, the valve body 42 is inserted into a valve body retaining structure or valve retainer 54 formed in the valve base 46. Thus assembled, the dispensing passageway 48 of the valve body 42 projects through the sealing means 22 and cap aperture 56 to engage the actuator means 16.

Sealing means 22 is retained in a cup portion 58 of the cap portion 28 to provide an effective seal between the cap portion 28 and the valve means 24 to prevent escape of substance and/or propellant disposed within the container 12. The sealing means 22 is comprised of a gasket member or gasket 60 formed of a silicone material and a protective liner or liner 62 formed of Teflon. Teflon is the trademark for tetrafluoroethylene fluorocarbon polymers manufactured by E. I. DuPont de Nemours & Co.

The gasket 60 and the liner 62 are positioned such that the liner 62 covers a surface 64 of the gasket 60 which faces inwardly towards the inside of the container 12. The silicone material used for the gasket 60 provides resiliency, sealing and friction reducing characteristics necessary for effective operation of the valve assembly 10, however, it is subject to deterioration when exposed to the chemicals in the substance and/or propellant. The Teflon material used for the liner 62 is inert to these chemicals and therefore provides a protective barrier to isolate the gasket 60 from the deteriorating chemicals in the substance and/or propellant disposed within the container. The Teflon liner 62 is sufficiently flexible to deform when the valve seating portion 50 is biasedly pressed thereagainst when the valve is turned off. Further, while other materials may be used for the sealing means 22 the materials described herein are preferred.

Both the gasket 60 and the liner 62 have apertures 66, 68 (respectively) formed therethrough. The gasket aperture 66 and the liner aperture 68 are generally coaxial with the cap aperture 56, actuator nozzle 30 and the valve means 24. More specifically, the hollow dispensing passageway 48 projects through these coaxial apertures to deliver the substance from the inside of the container 12 without contacting the gasket 60 material when the valve means 24 is actuated by the actuator means 16. When the valve means 24 is not downwardly displaced, the seating portion 50 of the valve body 42 is biasedly urged upwardly by the spring 44 compressing the sealing means 22 into the cup portion 58 to seal the container 12 and stop the dispensing of the substance.

Figure 3:
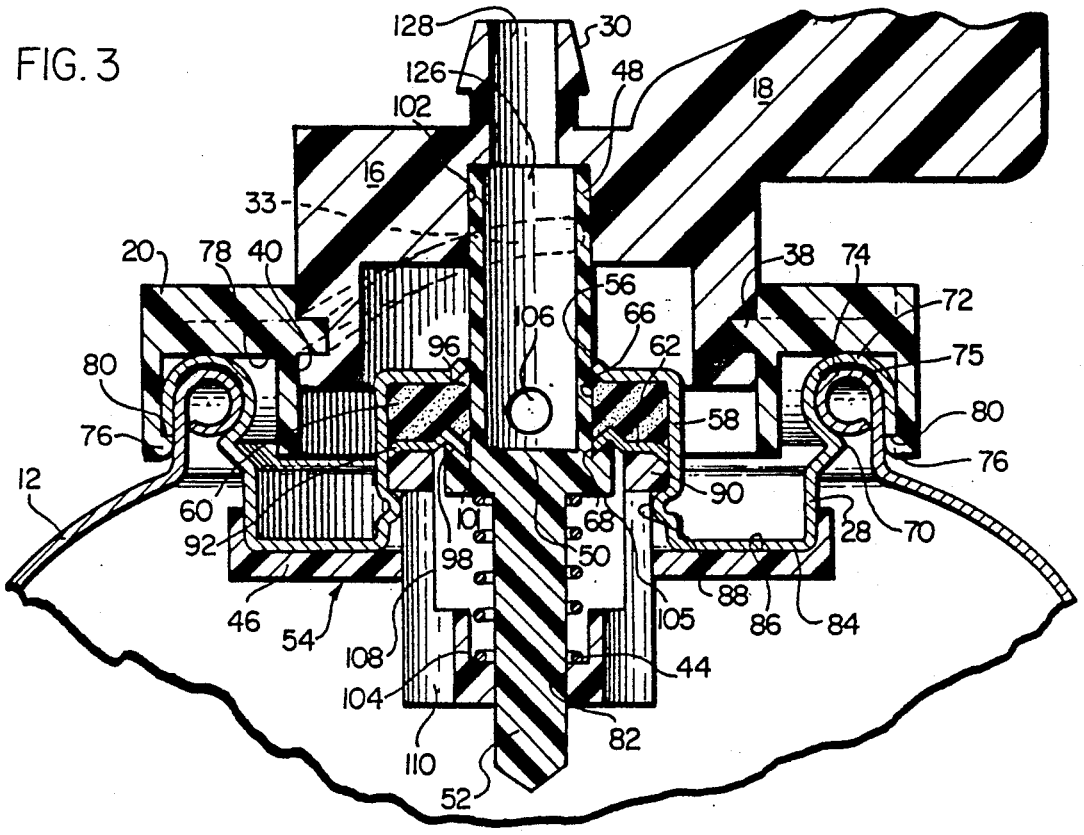
FIG. 3 is a sectional view of the valve assembly of the present invention assembled and installed on an aerosol container and further illustrating the valve in a closed position.

The valve means 24 as shown in partial cross section in FIG. 3, provides an illustration of the valve in a closed position. The valve means 24 are assembled to the cap portion 28 prior to attachment to the container as will be herein described. First, the gasket member 60 is inserted into the cup portion 58 over which the liner 62 is positioned. Next, the spring 44 is disposed within the valve body retaining structure or valve retainer 54 of the valve base 46 and the stem portion 52 of the valve body 42 is inserted through the center of the coil spring 44 and through a valve retainer aperture 82 formed through the bottom center of the valve retainer 54. With the valve means 24 and the sealing means 22 thus positioned, the dispensing passageway 48 of the valve body 42 is inserted through the liner aperture 68, gasket aperture 66 and the cap aperture 56 whereupon this assembly is compressed such that an downwardly directed surface 84 of the cap 28 abuts an upwardly directed surface 86 of the valve base 46. Once the assembly is in the described compressed state, a valve retaining crimp 88 is formed around the outside of the cup portion 58 engaging a valve retaining lip 90 formed around the top edge of the valve retaining structure 54.

The valve means 24 and sealing means 22 thus assembled with the cap 56 effectively seal the container 12, when attached thereto, and retains the liner 62 to prevent exposure of the gasket 60 to the chemicals in the substance and/or propellant disposed within the container 12. More specifically, the liner 62 is formed with an outside diameter slightly larger than the inside diameter of the cup 58 so that when the valve retaining lip 90 compresses the liner 62 against the gasket 60, an outside edge portion 92 of the liner 62 is wedged between the valve retaining lip 90 and the inside surface of the cup 58. Wedging of the liner 62 as such securely retains the liner 62 and prevents the liner 62 from being pulled away from the cup 58 when the seating portion 50 presses thereagainst. Further, the seal between the gasket 60, dispensing passageway 48 and the cap aperture 56 is enhanced by flaring the cap aperture edge 94 slightly outwardly thereby forming a wedge 96 of gasket material between the inside surface of the cap aperture edge 94 and the dispensing passageway 48.

The series of apertures 56, 66, 68 through which the dispensing passageway 48 projects is sealed by the seating portion 50 biasedly compressibly engaging the liner 62 when the valve is in the off position. The face of the seating portion 50 which abuts the liner 62 is formed with a generally downwardly sloping pointed rim 98 forming a channel 103. The pointed rim 98 which concentrates the sealing forces at the point of the rim of the seating portion to improve the effectiveness of the seal.

In order for this configuration to operate, the Teflon liner material 62 must be approximately 0.005 thick and the diameter of the liner aperture 68 must be slightly smaller than the outside diameter of the dispensing passageway 48. With the above liner constraints satisfied, the rim 98 of the seating portion 50 compresses the flexible liner 62 into the gasket 60 wedging a portion 99 of the gasket 60 and a portion of the liner 62 into the downwardly sloping inside channel 103 of the seating portion 50 isolating the gasket 60 from chemicals and/or propellant disposed within the container 12.

It should be noted that thinner Teflon material may be used for the liner 62 as long as the liner 62 possesses sufficient flexibility and strength to withstand the sealing forces placed thereupon by the seating portion 50. Currently, ultra thin Teflon material and/or Teflon coatings are not feasible because they tend to crack when sealing forces are imposed thereupon thus resulting in the undesired exposer of the gasket material to chemicals and/or propellant. Further, a flat non-pointed seating portion rim does provide sufficient sealing of the gasket 60 from deteriorating chemicals.

FIG. 3 further provides a sectional view of the valve assembly 10 of the present invention as assembled and installed on the aerosol container 12. The valve assembly 10 is adapted for mounting to the container 12 and preferably, although not necessarily, is retained thereupon through the cooperation of crimps and clips. For example, the container cap portion 28 with the valve assembly 10 attached as described above, is retained on the top portion of the container 12 by a cap crimp 70 which cooperatively retains a cap channel portion 72 on top of a container rim bead 74. A sealant 75 is applied to either the cap channel portion 72 or the rim bead 74 to provide additional sealing between the cap channel 72 and the top bead 74.

With the cap means 28 thus retained on the top of the container 12, the retention means 20 can be fixedly attached to the top of the container 12. As shown in the cross section of FIG. 3, the retention means 20 is formed with a circular channel 78 which accommodates the bead formed by the cap 28 retained on the top bead 74. Along the bottom of the outside edge of the retention means 20, a retention means retaining flange or collar flange 76 is formed to cooperatively engage a cap edge 80 of the cap 28 mounted on top of the container 12. Having thus positioned the retention means 20 on the cap 28, the actuator means 16 can be engaged with the retention means 20 as described above.

Figure 5:
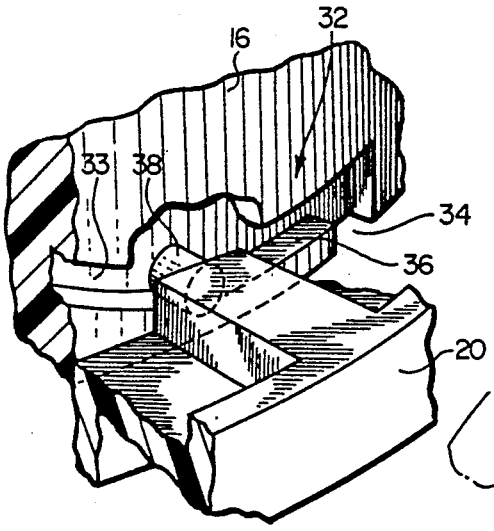
FIG. 5 is an enlarged partial sectional view of the actuator and retention means broken away to illustrate the operation of a camming groove and pin arrangement as well as the structure of the dwell area within a camming groove.

FIG. 5 provides an enlarged partial sectional view of the actuator means 16 and retention means 20 broken away to illustrate the operation of the cam pin 38 positioned within the cam groove 32. As shown, the cam pin 38 projects into the cam groove 32 which is formed on the outside surface of the actuator means 16. FIG. 5 illustrates the valve in the off position such that the cam pin 38 is generally positioned in the horizontal dwell portion 36 of the cam groove 32. When the cam pin 38 is positioned in the dwell portion 36, the valve assembly 10 is off and will not dispense. If the actuator means is rotated towards the assembly notch 34, the actuator means 16 can be removed from the valve assembly 10 by sliding the cam pin 38 through the assembly notch 34 and lifting upwardly on the actuator means 16. Thus disassembled, a user has access to the hollow portion of the dispensing passageway 48 as well as the actuator means receiving bore 40 for cleaning such areas.

If the actuator means 16 is rotated towards the upwardly directed spiral portion 33 of the spiral cam groove 32, the cam pin 38, fixedly positioned relative to said container, tracks upwardly along the cam groove 32 forcing the actuator means in a downward direction. Such rotation of the actuator means linearly downwardly displaces the seating portion 50 of the valve body 42 from its sealing engagement with the sealing means 22 thereby opening the valve to permit dispensing of the substance retained within the container 12.

Figure 4:
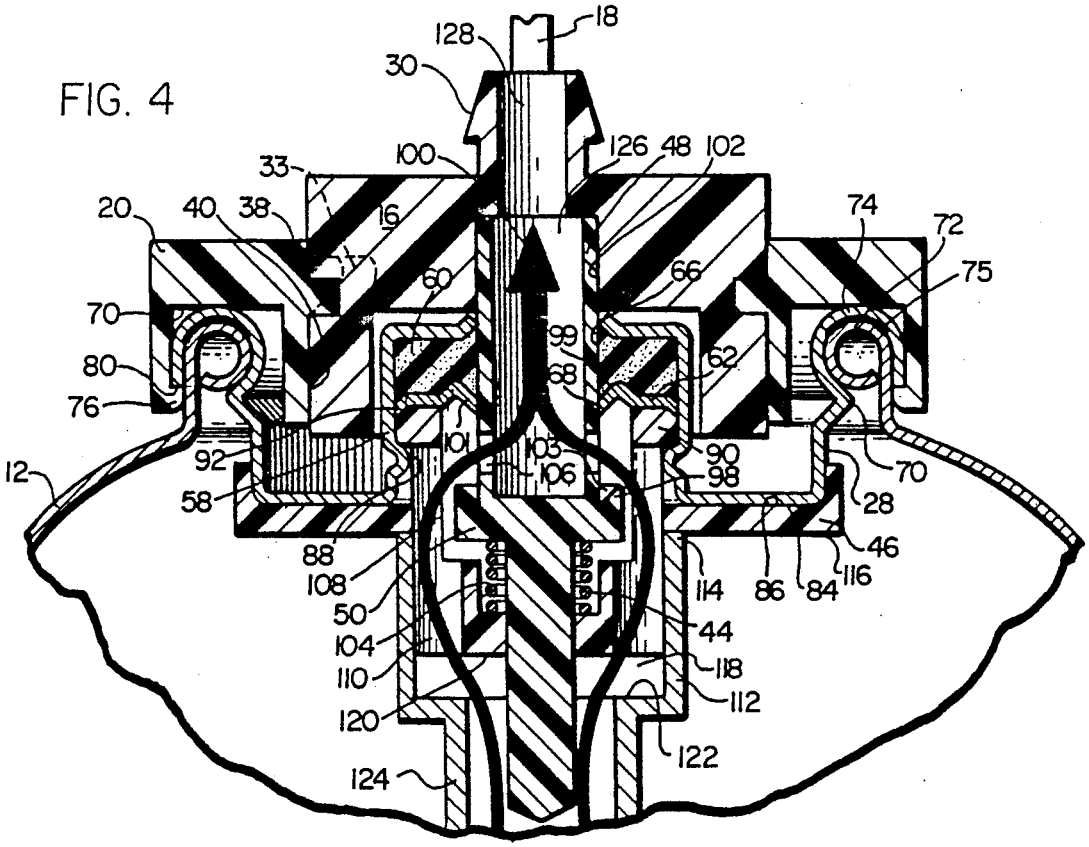
FIG. 4 is a sectional view of the valve assembly of the invention assembled and mounted to a top portion of an aerosol container showing the valve in an open position whereby the actuator biasedly displaces the valve stem.

As shown in FIG. 4, the actuator means 16 has been rotated 90° to linearly downwardly displace the valve body 42 to open the valve thus allowing the substance retained within the container 12 to flow (as indicated by arrow 100) through the valve assembly 10. When the actuator 16 is rotated as such the pins 38 track the grooves 32 with the actuator 16 traveling a greater distance rotationally than linearly. This camming action provides increased precision in the control of the valve while dispensing foam. The camming arrangement effectively reduces the rotational movement of the actuator 16 resulting in a smaller, more precise, linear movement of the valve body 42. Small linear movement of the valve body 42 provides controlled exposure of the port 106 formed through the valve body 42.

Downward movement of the valve body 42 by the camming action compresses the spring 44 between the bottom side 105 of the seating portion 50 and a spring retaining portion 104 of the valve body retaining structure 54. Sufficient continued downward force reveals ports 106 formed through the side of the dispensing passageway 48 thus permitting the dispensed substance 100 to flow through the ports 106 into the dispensing passageway. Once the force rotating the actuator 16 is removed, the spring 44 forces the actuator 16 upwardly to seal the valve and return it to the off position. The compressed spring force is transmitted through the cam pins 38 and cam grooves 32 creating a rotary motion while the actuator 16 is restored to the off position.

As shown in FIG. 4, the valve body retaining structure 54 has several openings 108 formed therethrough to permit substance flow 100 through the valve retainer 54 when the valve is opened. The openings 108 include a concave portion formed in the base of the valve retainer 54 permitting substance to flow through the concave portion 110 and through the opening 108 when an adapter portion 112 of the dip tube 26 is attached to the lower portion of the valve retainer 54. Thus attached, an upper portion 114 of the adapter 112 abuts an underside surface 116 of the valve base 46 to maintain a gap 118 between the bottom 120 of the valve retainer 54 and an inside bottom surface 122 of the adapter 112. This gap 118 permits the pressurized substance flow 100 up through a dip tube neck portion 124 through the gap 118 up through the valve retainer openings 108 and through the port 106 of the dispensing passageway 48.

Linear displacement of the valve body 42 retained in the valve assembly 10 controllably exposes and conceals the port 106 in the dispensing passageway 48 to permit or stop substance flow 100. That is to say that the degree to which the port 106 is exposed is controlled by the position of the lever 18. Accordingly, since the rate of flow of the product from the valve is determined by the relative degree of exposure, lever 18 can be manipulated to attain a degree of control of the dispensing of the product from the valve. When substance flows into the dispensing passageway 48, the substance changes from a polyurethane liquid to a polyurethane foam due to the reduction in pressure. When the valve is closed and the ports 106 are concealed by the sealing means 22, the substance flow 100 is ceased and the polyurethane material which remains in the passageway throat 126 continues to foam until the foaming reaction stops. For storage, this already activated foam can be easily removed with a probe inserted through the nozzle throat 128 of the nozzle 30. Prior to cleaning, the activated foam remaining in the passageway throat 126 generally does not have an effect on the gasket 60 since it is generally the propellant which causes deterioration of the gasket 60.

Further, regardless of the position in which the container is used, either upright or inverted, the gasket 60 is protected against the deteriorating effects of the propellant by the protective liner 62 positioned therebetween. Additionally, the liner 62 tends to have a wiping action along the outside of the dispensing passageway thereby removing any excess polyurethane substance deposited upon dispensing the substance and preventing potential gasket failing clogging of the sealing means 22.

The invention is claimed as follows:

1. A valve assembly for use with an aerosol container or the like for controllably dispensing a substance disposed within said container under pressure of a propellant also contained therein, said valve assembly comprising: actuator means operatively attached to said container for controllably axially displacing biased valve means operatively retained in said container; said biased valve means operatively engaged with said actuator means and adapted to be carried by said container for controllably releasing said substance when said actuator means is operated to axially displace said biased valve means; sealing means positionable inside of said container and operatively associated with said valve means for releasably sealing said valve assembly in said aerosol container, said sealing means comprising a resilient gasket member and a discrete protective liner covering one surface of said gasket member, said gasket member providing a releasable seal for retaining said substance in said container with said protective liner abutting a surface of said resilient gasket facing towards said container and positioned between said resilient gasket member and said biased valve means for preventing exposure of said gasket member to the chemicals in said substance or propellant disposed within said container.

2. A valve assembly according to claim 1 in which said resilient gasket member is formed of a silicone substance and said protective liner is formed of Teflon.

3. A valve assembly according to claim 2 wherein said valve means is formed with a valve body having a tubularly shaped dispensing passageway operatively engaged with said actuator means in a generally tight yet operable interface fit for engagably rotating said valve body when said actuator is engaged to dispense said substance such that accumulation of said substance along an operative boundary of said valve body is dislodged to prevent fouling of said valve assembly.

4. A valve assembly according to claim 3 in which said valve body is formed with a seating portion positioned below said dispensing passageway having a disk shaped structure coaxial with and having a diameter slightly greater than said dispensing passageway, said seating portion having an outside diameter greater than an aperture formed through said protective liner through which said dispensing passageway projects and a generally pointed rim is formed on a surface of said seating portion abutting said protective liner of said sealing means for concentrating sealing forces created by said seating portion on said sealing means when biasedly urged into abutting engagement with said protective liner when said actuator is not displacing said valve body, said concentrated sealing forces creating a seal around the perimeter of said aperture formed through said protective liner.

5. A valve assembly according to claim 3 in which said protective liner is flexibly deformable upon application of sealing forces created by said seating portion of said valve stem abutting said protective liner when said seating portion is biasedly urged into abutting engagement with said protective liner.

6. A valve assembly for use with an aerosol container or the like for controllably dispensing a substance disposed within the container under pressure of a propellant also contained therein, said valve assembly comprising: valve means adapted to be carried by said container for controllably releasing said substance when said valve means is operated; actuator means for operating said valve means; sealing means positionable inside of said container and operatively associated with said valve means, said sealing means comprising a resilient gasket member and a protective liner covering one surface of said gasket member, said gasket member adapted to provide an operative seal for retaining said substance in said container with said protective liner positioned between said resilient gasket means and said valve means for preventing exposure of said gasket member to the chemicals in said substance or propellant disposed within said container, said protective liner having an outside diameter slightly greater than the diameter of said gasket member for creating an effective barrier seal between said substance and said propellant disposed within said container at an interface boundary between said valve means and said gasket member such that said protective liner is compressibly retained between said gasket member and said valve means.

7. A valve assembly according to claim 6, wherein a lever is attached to said actuator for controllably rotating said actuator to dispense a substance from said container, said lever generally extending radially from said actuator means, said actuator being operable by a single finger of a hand gripping said container using a generally rotary motion.

8. A valve assembly for use with an aerosol container or the like for controllably dispensing a substance disposed within said container under pressure of a propellant, said valve assembly comprising; a valve body including port means through which said substance can pass, biasing means for biasing said valve body to a valve closed position, wherein said valve body may be moved in opposition to said biasing means to a valve open position; sealing means positioned about said valve body for controlling the dispensing of said substance, said sealing means comprising a resilient gasket member and a protective liner covering one surface of said gasket member, said sealing means retaining said substance within said container with said protective liner positioned between said resilient gasket member and said substance within the container for preventing exposure of said gasket member to chemicals in said substance or propellant disposed within said container.

9. A valve assembly according to claim 8, wherein said gasket member is formed of a silicon substance and said protective liner is formed of Teflon.

10. A valve assembly according to claim 8, wherein said protective liner has an outside diameter slightly greater than the diameter of said gasket member for creating an effective barrier seal between said substance and said propellant disposed within said container at an interface boundary between said valve body and said gasket member such that said protective liner is compressibly retained between said gasket member and said valve body.

11. A valve assembly according to claim 8, further including actuator means for producing displacement of said valve body from the valve-closed position to the valve-open position, said actuator means comprising a collar mountable to said container, an actuator member received within said collar, cam means interconnecting said actuator with said collar and a lever member formed on said actuator member for imparting rotary motion to said actuator member whereby the cam means will cause said actuator to move linearly with respect to said collar upon relative rotation and produce corresponding linear movement of said vale body between the valve open and valve closed positions.

12. A valve assembly according to claim 11, wherein said actuator means permits precision control of said valve means, said container being retainable in a hand of a user and said actuator being controllable by a digit of the same hand in which said container is held.

13. A valve assembly for use with an aerosol container for controllably dispensing a substance retained in said container under pressure of a propellant, said valve assembly including: valve means operatively attached to said container for controlling flow of said substance from said container; actuator means operatively engaged with said valve means for controllably displacing said valve means; retention means for attaching said valve assembly to said container; and cam means operatively attaching said actuator means to said retention means for translating rotary movement of said actuator means into linear movement of said valve means relative to said top portion of said container for controllably moving said valve means and correspondingly controlled dispensing of said substance from said container, said cam means including at least one camming pin attached to said retention means and engaged with a corresponding continuously sloping spiral camming grove formed on a cooperative surface of said actuator for consistently and precisely controlling displacement of said valve means; sealing means for sealing said valve means for retaining said substance disposed therein, said sealing means formed with an aperture therethrough through which a dispensing passageway portion of said valve means projects; said sealing means further including a resilient gasket member positioned around said dispensing passageway covering said aperture through which said dispensing passageway portion projects and a protective liner covering a surface of said gasket member directed inwardly towards said container for preventing exposure of said gasket member to chemicals in said substance or propellant disposed within said container, said gasket member being sized and dimensioned for operatively sealing said valve means in said container for retaining said substance in said container.

14. A valve assembly for an aerosol container for use in the controlled dispensing of a substance contained within said container, said valve assembly including; valve means mountable to said container and including a linearly movable valve body member for controlling flow of said substance from said container; actuator means mountable to said container for operating said valve means, said actuator means comprising a collar member mountable to said container, an actuator member disposed within said collar member and in engagement with said valve means, cam means interconnecting said actuator member and said collar member such that rotary movement of said actuator member relative to said collar member results in linear displacement of said actuator member relative to said collar member such that said actuator member effects operation of said valve means, and a lever member carried by said actuator member to permit operation thereof; sealing means positioned about said valve body for controlling the dispensing of said substance, said sealing means comprising a resilient gasket member and a protective liner covering one surface of said gasket member, said sealing means retaining said substance within said container with said protective liner positioned between said resilient gasket member and said substance within the container for preventing exposure of said gasket member to chemicals in said substance or propellant disposed within said container.

15. A valve assembly for an aerosol container for use in the controlled dispensing of a substance contained within said container, said valve assembly including; valve means mountable to said container and including a linearly movable valve body member for controlling flow of said substance from said container; actuator means mountable to said container for operating said valve means, said actuator means comprising a collar member mountable to said container, an actuator member disposed within said collar member and in engagement with said valve means, cam means interconnecting said actuator member and said collar member such that rotary movement of said actuator member relative to said collar member results in linear displacement of said actuator member relative to said collar member such that said actuator member effects operation of said valve means, and a lever member carried by said actuator member to permit operation thereof; sealing means positioned about said valve body for controlling the dispensing of said substance, said sealing means comprising a resilient gasket member formed of a silicon substance and a protective liner formed of Teflon covering one surface of said gasket member, said sealing means retaining said substance within said container with said protective liner positioned between said resilient gasket member and said substance within the container for preventing exposure of said gasket member to chemicals in said substance or propellant disposed within said container.

* * * * *